US005715958A

United States Patent [19]

Feider et al.

[11] Patent Number: 5,715,958

[45] Date of Patent: Feb. 10, 1998

[54] STABILIZER FOR A GANTRY CRANE LIFT FRAME

[75] Inventors: Thomas Feider; Norbert Lenius, both of Sturgeon Bay, Wis.

[73] Assignee: Marine Travelift, Inc., Sturgeon Bay, Wis.

[21] Appl. No.: 377,427

[22] Filed: Jan. 24, 1995

[51] Int. Cl.[6] ..... B66C 13/06

[52] U.S. Cl. ..... 212/273; 212/319; 212/344; 212/345; 414/460

[58] Field of Search ..... 414/460, 273; 212/272, 314, 318, 319, 326, 327, 333, 334, 335

[56] References Cited

U.S. PATENT DOCUMENTS

| | | | |
|---|---|---|---|
| 3,146,903 | 9/1964 | Bjorklund . | |
| 3,161,309 | 12/1964 | Baudhuin et al. . | |
| 3,176,853 | 4/1965 | Baudhuin et al. . | |
| 3,241,686 | 3/1966 | Hurst . | |
| 3,251,496 | 5/1966 | Lamer et al. . | |
| 3,396,858 | 8/1968 | Baker et al. . | |
| 3,438,510 | 4/1969 | Fawell | 212/334 |
| 3,558,172 | 1/1971 | Lamer et al. . | |
| 3,645,406 | 2/1972 | Brazell . | |
| 3,792,779 | 2/1974 | Brazell . | |
| 4,135,628 | 1/1979 | Harris et al. . | |
| 4,169,977 | 10/1979 | Pedersen | 212/319 |
| 4,244,663 | 1/1981 | Croghan . | |
| 4,273,242 | 6/1981 | Schaper . | |
| 4,279,347 | 7/1981 | Appleman . | |
| 4,358,020 | 11/1982 | Thiele . | |
| 4,544,070 | 10/1985 | Sickler . | |
| 4,587,383 | 5/1986 | Stoldt . | |
| 4,747,745 | 5/1988 | Pippen et al. . | |
| 4,749,328 | 6/1988 | Lanigan, Jr. et al. . | |
| 4,877,365 | 10/1989 | Lanigan, Jr. et al. . | |
| 4,915,576 | 4/1990 | Lanigan, Jr. et al. . | |
| 5,114,295 | 5/1992 | Jansson . | |
| 5,186,342 | 2/1993 | Shimizu . | |

FOREIGN PATENT DOCUMENTS

| | | | |
|---|---|---|---|
| 2 253 699 | 8/1975 | France . | |
| 2 265 664 | 11/1975 | France . | |
| 2 295 904 | 8/1976 | France . | |
| 2 430 387 | 7/1978 | France . | |
| 1074241 | 1/1960 | Germany | 212/334 |
| 2138496 | 2/1973 | Germany | 212/334 |
| 24 10 807 | 9/1975 | Germany . | |
| 3718389 | 2/1988 | Germany | 414/460 |
| 925-846 | 5/1982 | Russian Federation . | |
| 1324991 | 7/1987 | U.S.S.R. | 212/272 |
| 1206413 | 9/1970 | United Kingdom | 212/335 |

*Primary Examiner*—Thomas J. Brahan
*Attorney, Agent, or Firm*—Wallenstein & Wagner, Ltd.

[57] ABSTRACT

A gantry crane 10 is provided having a gantry structure 12 with a pair of front support legs 18 and 20 and a pair of rear support legs 26 and 28. A lift frame 14, having opposed first and second ends 14*a* and 14*b*, is suspended from the gantry structure 12. A stabilizing beam 68 operatively connects the lift frame 14 to the gantry structure 12 to prevent sway of the lift frame 14. The stabilizing beam 68 is positioned between the pair of front support legs 18 and 20 and the pair of rear support legs 26 and 28. Preferably, the stabilizing beam 68 is connected proximate a longitudinal center of the lift frame 14. The stabilizing beam 68 is connected to vertical guides 70 and 72 that are connected to the gantry structure 12 so as to be vertically moveable along the guides 70 and 72. A four corner cross-reeving/clutch system 79 is provided to dampen rotational sway of the ends 14*a* and 14*b* of the lift frame 14. A gimbal 100 is provided for connecting the stabilizing beam 68 to the lift frame 14 to permit rotation of the lift frame 14 in a horizontal plane about a vertical axis, and rotation of the lift frame about a horizontal axis. The connection between the stabilizing beam 68 and vertical guides 70 and 72 allow the lift frame 14 to rotate within a vertical plane.

3 Claims, 8 Drawing Sheets

STABILIZER FOR A GANTRY CRANE LIFT FRAME

TECHNICAL FIELD

The present invention relates to apparatus for stabilizing a lift frame suspended from a crane and more particularly to reeving and beam type apparatus connected between a gantry structure and a lift frame to stabilize sway of the lift frame while maintaining maneuverability of the lift frame.

BACKGROUND OF THE INVENTION

Gantry cranes have been used for many years for lifting and handling loads such as truck trailers, cargo containers, boats and the like. The cranes normally have a gantry structure that spans over the load(s), for example, two adjacent railroad cars or a truck trailer adjacent a railroad car. Conventionally, a lift frame is suspended by flexible cables from the gantry structure. Spreaders located at or near each end of the lift frame engage a load either from the top or bottom of the load. For example, arms, having twist locks or fingers, may be provided to extend down from both sides of the lift frame and engage a load, such as a truck trailer, at the bottom of the trailer. Such arms can also rotate to an inoperable position so that optional, specialized hooks, can be provided on the spreader to engage a load, such as a cargo container, from the top of the container.

When the load is moved, it tends to sway because it is suspended from flexible cables via the lift frame. The cables give way to inertial forces acting on the load creating inertial sway, or uncontrolled movement. For example, if a load is lifted then moved from left to right, when crane trolleys that move the lift frame stop, the heavy load continues on its left-to-right inertial path. At times, the load can be suspended many feet below the gantry, which can increase inertial sway. Wind can also contribute to sway of the load. Inertial sway is particularly a problem with self-mobile gantry cranes because the crane often traverses uneven ground while carrying the load.

Although inertial sway, or sway, can occur along many and complex vectors, it is conventionally described in terms of its longitudinal and lateral components. For example, longitudinal sway occurs when the lift frame moves in a fore-to-aft direction relative to the gantry structure, in other words, parallel with the longitudinal axis of the lift frame. The longitudinal sway (as with all sway) is a pendulous motion of the entire lift frame from front to back of the gantry structure. As noted above, lateral sway occurs when the lift frame moves in a side-to-side direction relative to the gantry structure, in other words, transverse to the longitudinal axis of the lift frame. The lateral sway is also a pendulous motion of the entire lift frame from side-to-side within the gantry structure.

Another significant and more complex form of sway is rotational sway. Rotational sway of the lift frame can occur when force components, transverse to the longitudinal axis of the lift frame, act, for example, at only one end of the lift frame. When such forces act, the end of the lift frame twists or rotates within the gantry structure.

Sway is undesirable for a number of reasons. During sway, a load may collide with the gantry structure or adjacent objects. Sway can also make the entire gantry crane unstable. Further, when a load sways, it requires more time for an operator to engage and accurately maneuver a load. Sway can also place undue stress on the suspension cables and associated support apparatus.

Numerous techniques have been proposed for stabilizing the lift frame in a gantry crane to prevent sway of the suspended load. For instance, rigid connections between the lift frame and gantry structure are commonly employed. Special cable reeving arrangements are also used in an attempt to prevent or dampen sway of the suspended load.

One proposed method for stabilizing a suspended load is to connect each end of a lift frame to a stabilizing beam, as disclosed in U.S. Pat. Nos. 3,176,853; 3,251,496 and 3,558,172. Each of these patents discloses a pair of stabilizing beams spanning a gantry structure. The beam pairs are, in each case, vertically moveable along front and rear support legs respectively, of the gantry structure. In these proposed structures, load-bearing trolleys are directly connected to both ends of a lift frame. The trolleys, in turn, ride on the stabilizing beams to move the lift frame laterally within the gantry structure. The load is lifted by cables connected directly to the two stabilizing beams, thus, eliminating direct cable suspension of the lift frame itself.

While this design has enjoyed some degree of success, problems exist when employing two beams to stabilize sway as described above. Primarily, the ability to intentionally maneuver a load is restricted by such a dual-beam construction. For example, it is desirable and necessary to be able to rotate the lift frame in a horizontal plane within the gantry structure to accurately engage or maneuver a load. In other words, one end of the lift frame is sometimes desirably moved laterally to the right or to the left while the opposite end of the lift frame is moved laterally to the left or right respectively. The dual stabilizing beam design restricts such movement.

Another problem with the proposed dual stabilizing beam designs is that the weight lifted by the gantry crane is increased. Because the lift frame is directly lifted by the stabilizing beams, the stabilizing beams must be of sufficient mass to carry the weight of both the lift frame and a load. Such a design, therefore, requires the cables and winches of the gantry crane to lift not only the lift frame and load, but also the two heavy stabilizing beams.

Another proposed structure for limiting sway is disclosed in U.S. Pat. No. 4,279,347. Disclosed therein is a crane having a lift frame suspended from a gantry structure. A single stabilizing beam spans the gantry structure and moves vertically on front support legs of the gantry structure. The stabilizing beam is suspended by cables from the gantry structure. A front end of the lift frame is directly connected to a trolley on the stabilizing beam. A rear end of the lift frame is pendulously suspended from the rear of the gantry structure by flexible cables only. Thus, only the front end of the lift frame is fixed, or restrained on a stabilizing beam.

The fixed connection at the front of the lift frame prevents longitudinal sway of the entire lift frame, but only the front end of the lift frame is restrained from lateral sway within the gantry structure. Lateral sway at the rear end of the lift frame is effected only by cable reeving. The sole reliance on cable reeving to prevent lateral sway of one end of the lift frame, is unsatisfactory for uniform stabilization of the entire lift frame.

This single stabilizing beam design has additional problems. First, the gantry crane again requires a load-carrying stabilizing beam that must carry the weight of the lift frame and a load. The weight lifted by the cables and winches of the gantry crane is thus increased. Second, with only one fixed connection at the front end of the lift frame, forces exerted on the lift frame, transverse to a longitudinal axis of the lift frame, will create a moment about the fixed connection of the lift frame. This causes rotational sway of the lift frame about the fixed connection at the front end of the lift frame.

U.S. Pat. No. 4,747,745 discloses a gantry crane having only two centrally located upright support legs. A lift frame is suspended from a transverse beam spanning between the two support legs. Two confronting stabilizing beams which ride on top of the lift frame are provided in an attempt to prevent longitudinal sway of the lift frame. The stabilizing beams are vertically moveable along the two support legs. Cable reeving is provided to attempt to control lateral sway. This design, however, does not maintain maneuverability of the lift frame. For example, the lift frame cannot rotate in a horizontal plane because lateral movement is provided by only one trolley that rides on the transverse beam.

Another problem exists with conventional gantry cranes. It is sometimes necessary for a gantry crane to engage a load that rests at an angle to a horizontal plane. When this occurs, an operator experiences difficulty in engaging the load because the spreader arms on only one side of the lift frame will align with the angled load. The arms on the other side of the lift frame will be misaligned due to the angled load. To engage the angled load, the lift frame must rotate about a horizontal axis, parallel with a longitudinal axis of the lift frame, to the same angle as the load. Conventional gantry cranes do not allow the lift frame to rotate in this manner.

Thus, there is a need for a stabilizing system for preventing sway of a lift frame suspending a load, such as for use on a gantry crane, that does not rely solely on cable reeving to prevent sway, does not require load-carrying stabilizing beams, and maintains the maximum of intentional maneuverability of the lift frame, i.e., rotation of the lift frame in a horizontal plane, rotation of the lift frame in a vertical plane, and rotation of the lift frame about a horizontal axis parallel with a longitudinal axis of the lift frame. The present invention is provided to solve these and other problems.

SUMMARY OF THE INVENTION

The present invention provides stabilizing apparatus for a gantry crane lift frame to control and prevent unwanted sway of the lift frame, while maintaining intentional maneuverability of the lift frame.

According to one aspect of the invention, a gantry crane is provided having a gantry structure with a pair of front support legs and a pair of rear support legs. A lift frame, having opposed first and second ends, is suspended from the gantry structure. A stabilizing beam operatively connects the lift frame to the gantry structure. The stabilizing beam is positioned between the pair of front support legs and the pair of rear support legs. The stabilizing beam can be connected to the lift frame between the first and second ends thereof. Preferably, the stabilizing beam is connected proximate a longitudinal center of the lift frame.

According to another aspect of the invention, a pair of vertical guides are mounted on opposite sides of the gantry structure. The stabilizing beam is connected to the guides so as to be vertically movable along the guides. The stabilizing beam has a longitudinal axis and means for rotating about its longitudinal axis.

According to another aspect of the invention, the gantry crane has means for dampening rotational sway of the lift frame. Preferably, a cross-reeving is connected between the gantry structure and an end of the lift frame to dampen rotational sway of the lift frame.

According to a further aspect of the invention, the gantry crane has means for connecting the stabilizing beam to the lift frame which permits the lift frame to move along the stabilizing beam. The means for connecting the stabilizing beam to the lift frame also has means for providing horizontal rotation of the lift frame about a vertical axis, and for permitting rotation of the lift frame about a horizontal axis, while the rotation of the stabilizing beam about its longitudinal axis allows the lift frame to rotate in a vertical plane.

Other advantages and aspects of the present invention will become apparent upon reading the following description of the drawings and detailed description of the invention.

BRIEF DESCRIPTION OF THE DRAWINGS

In order that the present invention may be more fully understood, it will now be described by way of example, with reference to the accompanying drawings in which.

DETAILED DESCRIPTION OF THE INVENTION

Figure 1:
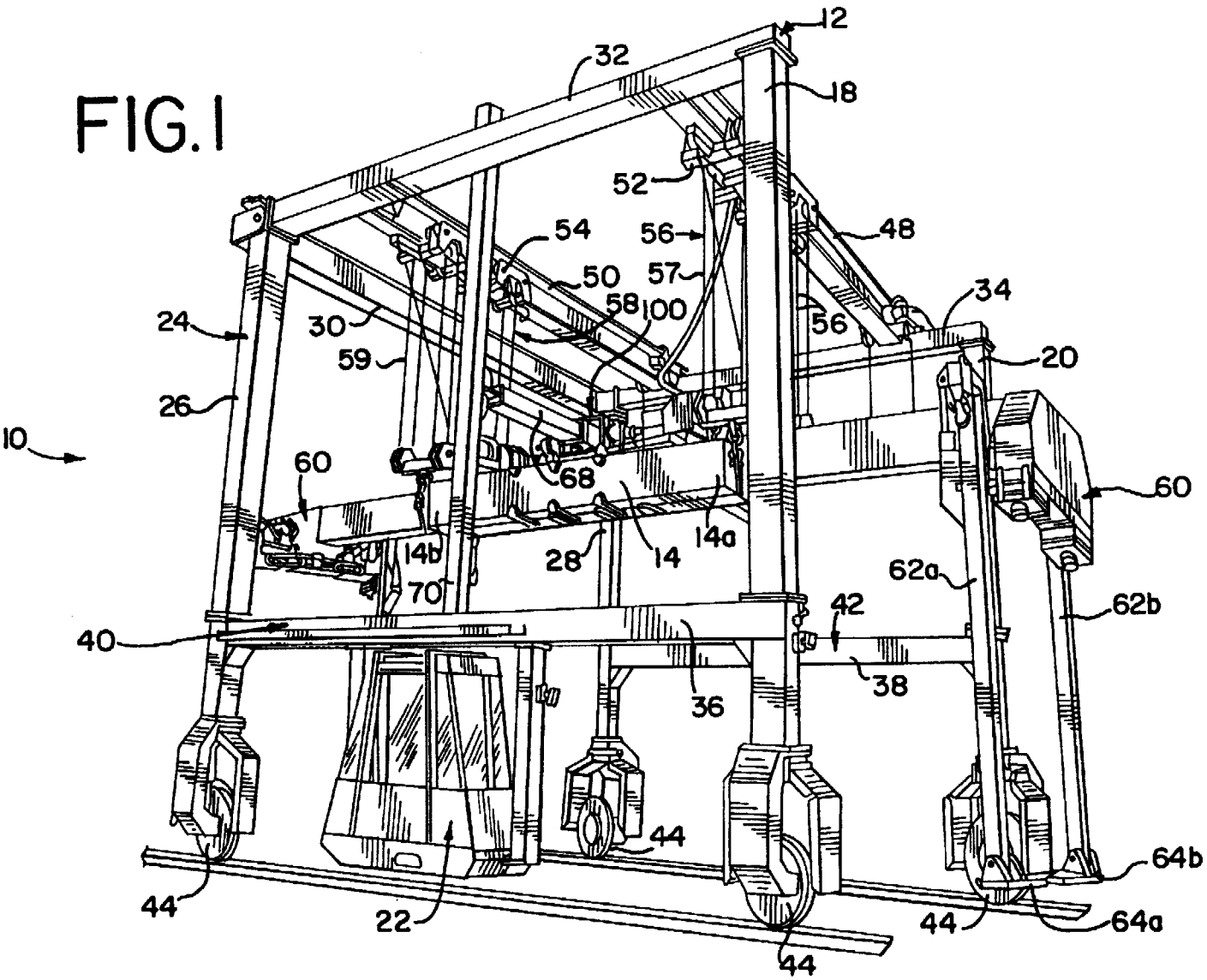
FIG. 1 is a perspective view of a gantry crane according to the present invention.

While this invention is susceptible of embodiment in many different forms, there is shown in the drawings and will herein be described in detail, a preferred embodiment of the invention with the understanding that the present disclosure is to be considered as an exemplification of the principles of the invention and is not intended to limit the broad aspect of the invention to the embodiment illustrated.

Figure 8:
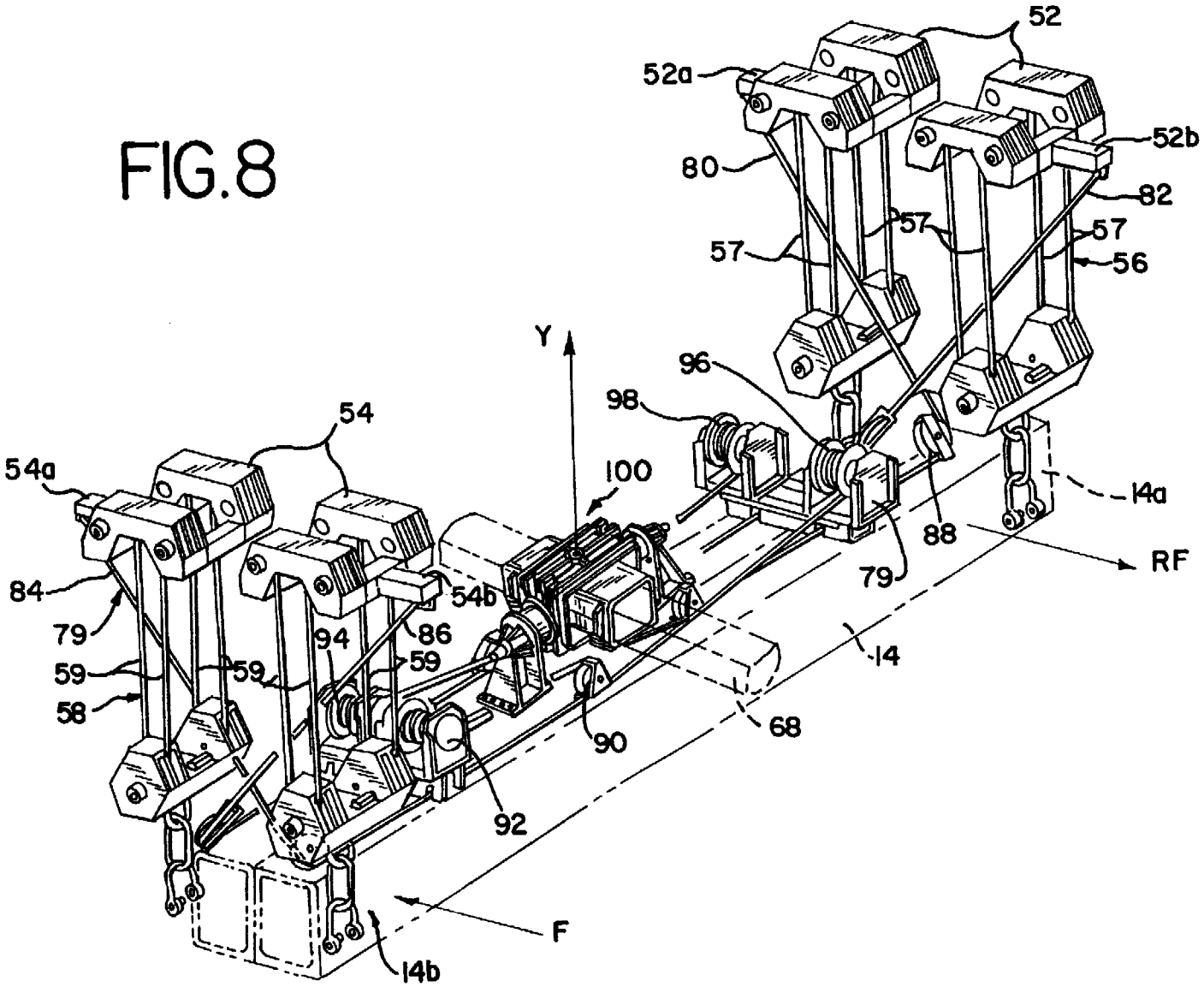
FIG. 8 is a partial view, in perspective, of trolleys and reevings of the gantry crane of FIG. 1, and a lift frame and stabilizing beam shown in phantom.
Figure 9:
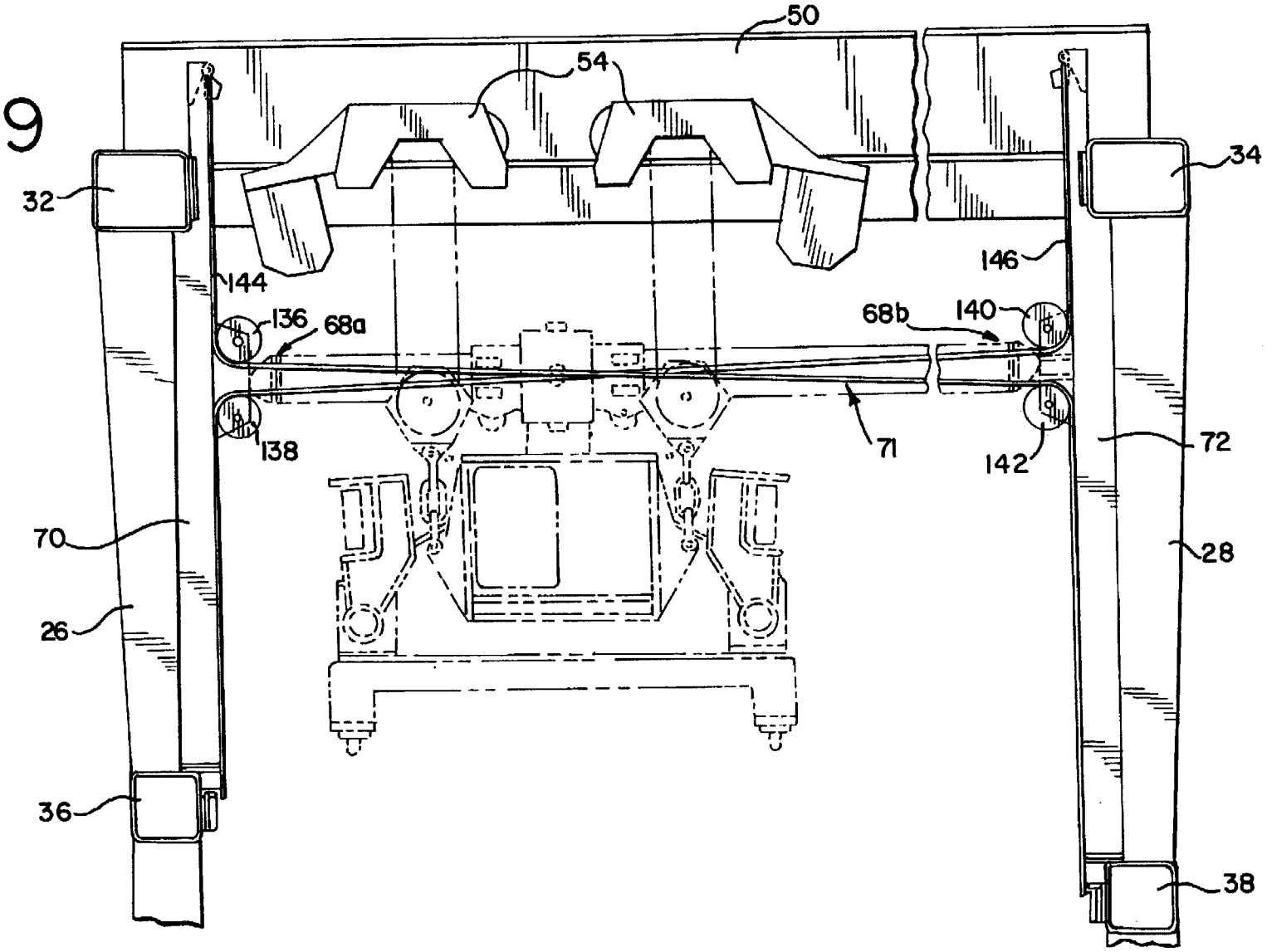
FIG. 9 is a cross-sectional view of the gantry crane of FIG. 1 taken along line 9—9 in FIG. 5 disclosing cable reeving passing within the stabilizing beam, some lines shown in phantom for clarity.
Figure 10:
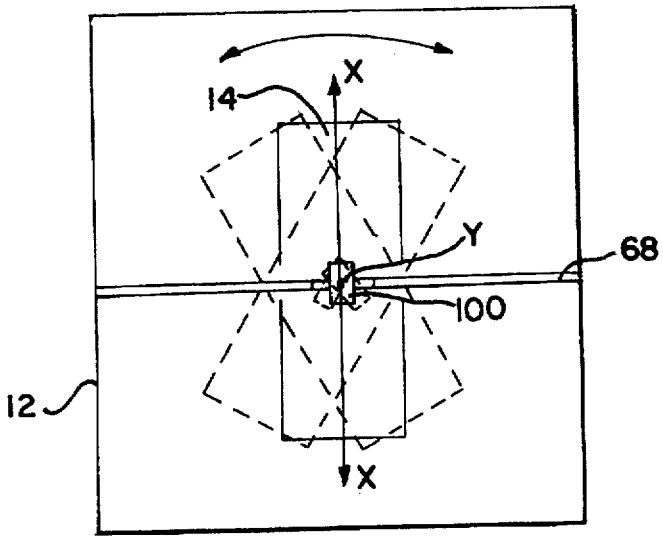
FIG. 10 is a schematic top view of the gantry crane of FIG. 1, illustrating rotation of the lift frame in a horizontal plane about a vertical axis.
Figure 11A:
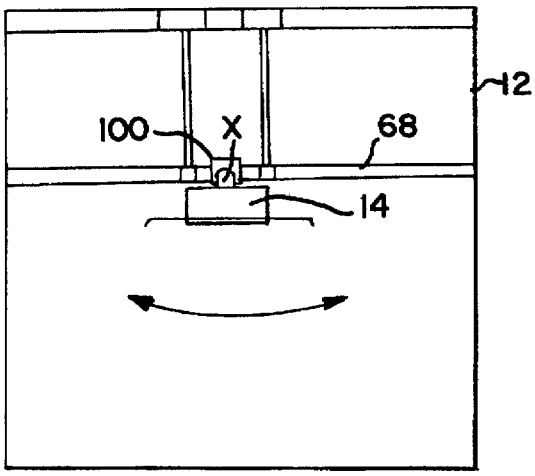
FIGS. 11(*a*) and 11(*b*) are schematic front views of the gantry crane of FIG. 1, illustrating rotation of the lift frame about a horizontal axis.
Figure 11B:
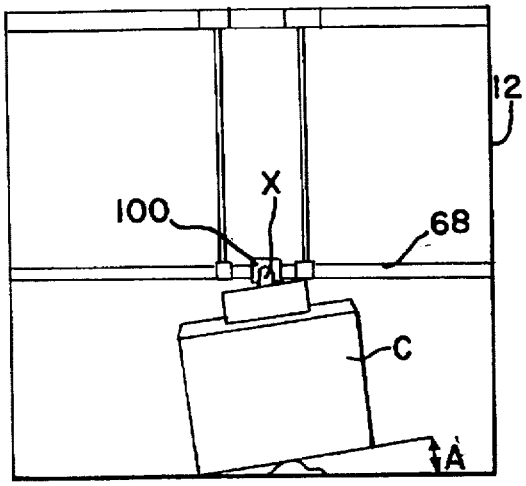
Figure 12:
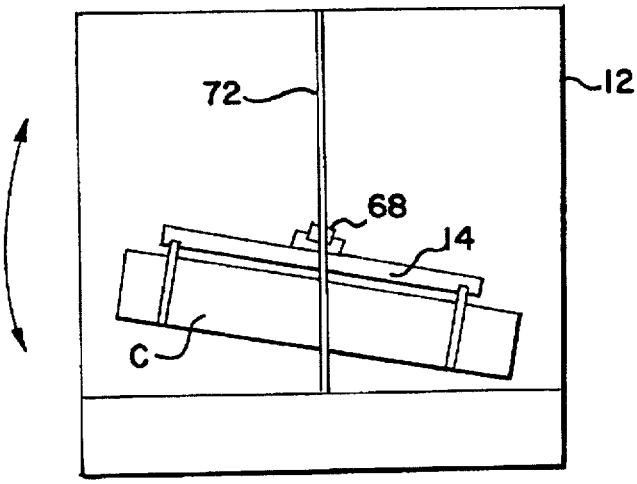
FIG. 12 is a schematic side view of the gantry crane of FIG. 1, illustrating rotation or tipping of the lift frame in a vertical plane.

FIGS. 1–9 disclose a gantry crane 10 constructed in accordance with the principles of the present invention. FIGS. 10–12 are schematic representations of three-dimensional maneuverability of the gantry crane 10. The structure of the gantry crane 10 will be described mostly referring to FIGS. 1–9 and then the operation of gantry crane 10 will be described referring additionally to FIGS. 10–12.

Gantry Crane Structure

As disclosed in FIG. 1, the gantry crane 10 generally includes a gantry structure 12 and a lift frame 14. The lift frame 14 is suspended from the gantry structure 12 by lift cables 57 and 59. The gantry structure 12 has four vertical legs 18, 20, 26 and 28. Legs 18 and 26 are connected near their bottom ends by a bottom rail 36 and are connected at their top ends by a top rail 32. Legs 20 and 28 are similarly connected near their bottoms ends by a bottom rail 38 and connected at their top ends by a top rail 34.

Legs 18 and 26 and the connecting top and bottom rails 32 and 36, respectively, define a first side support frame 40. Legs 20 and 28 and the connecting top and bottom rails 34 and 38, respectively, define a second side support frame 42.

The side support frames 40 and 42 are interconnected by cross-beams 48 and 50 which are spaced from each other. The cross-beams 48 and 50 are preferably I-beams and are mounted on a top side of the top rails 32 and 34.

As further disclosed in FIG. 1, a cross-beam 30, spanning between the side support frames 40 and 42, is provided at a rear end of the gantry structure 12. While cross-beam 30 adds to the rigidity of the gantry structure 12, its primary function is to provide a mounting bridge for routing hydraulic and electrical circuitry between the side support frames 40 and 42.

The gantry structure 12, thus formed, is an open-ended box-like structure sufficient to span over adjacent loads, such as two railcars or a railcar adjacent a truck trailer.

The gantry structure 12 is also equipped with four (4) wheels 44. One wheel 44 is located at a bottom end of each of the vertical legs 18, 20, 26 and 28. The wheels 44 are powered by hydraulic motors (not shown) to make the gantry crane 10 self-mobile. Although FIG. 1 discloses wheels 44 that ride on railroad tracks, gantry crane 10 can also be equipped with wheels 44 that roll on the ground. The gantry structure 12 could also be equipped with link-belt type tracks as used on many boom-type cranes. An operator cab 22 is mounted on side support frame 40 underneath lower beam 36. Although operator cab 22 is shown mounted near ground level, the cab 22 could also be mounted at an elevated position if desired.

As best disclosed in FIGS. 1, 4, 5 and 8, the lift frame 14 is suspended from a first trolley 52 and a second trolley 54 that ride on cross-beams 48 and 50 respectively. As best disclosed in FIG. 5, cross-beam 48 is positioned towards a front end **12*a* of the gantry structure 12 and cross-beam 50 is positioned towards a rear end 12*b* of the gantry structure 12. As best seen in FIG. 1, the first trolley 52 has a first cable reeving 56 that connects the first trolley 52 to a front end 14*a* of the lift frame 14. The second trolley 54 has a second cable reeving 58 that connects the second trolley 52 to a rear end 14*b* of the lift frame 14**.

As best disclosed in FIG. 8, cable reevings 56 and 58 include lift cables 57 and 59, respectively. Lift cables 57 and 59 extend from the trolleys to winches (winches not shown) that are mounted on the gantry structure 12. The winches raise and lower the lift frame 14 via the lift cables 57 and 59 through reevings 56 and 58 toward and away from the first and second trolleys 52 and 54. As the trolleys 52 and 54 move laterally on the cross-beams 48 and 50, the lift frame 14 is moved laterally within the gantry structure 12. These vertical and lateral translational movements of the lift frame 14 are intentional movements and are to be distinguished from unwanted swaying of the lift frame 14.

Figure 4:
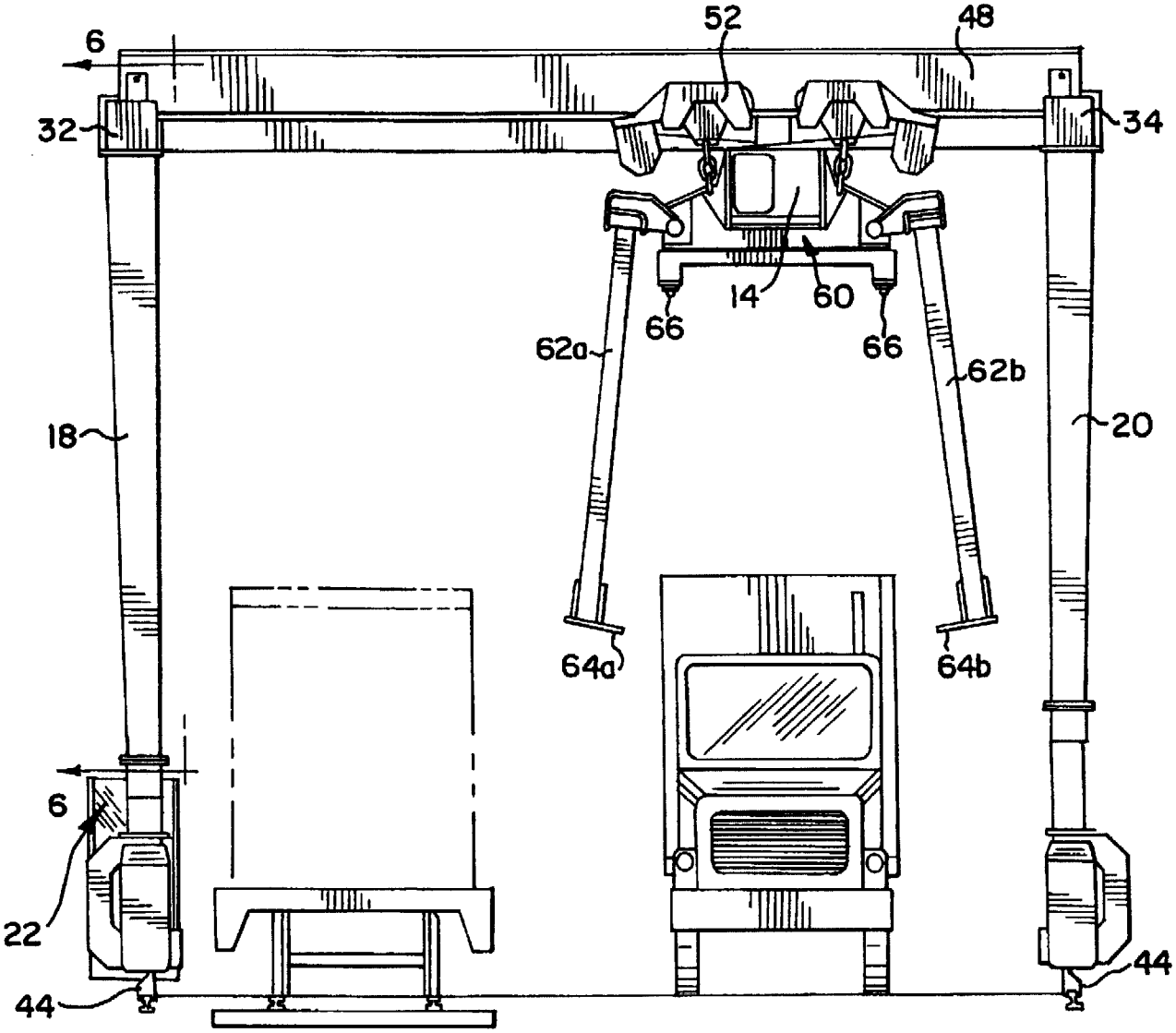
FIG. 4 is a front end view of the gantry crane of FIG. 1 spanning over a truck trailer and an adjacent railcar.
Figure 5:
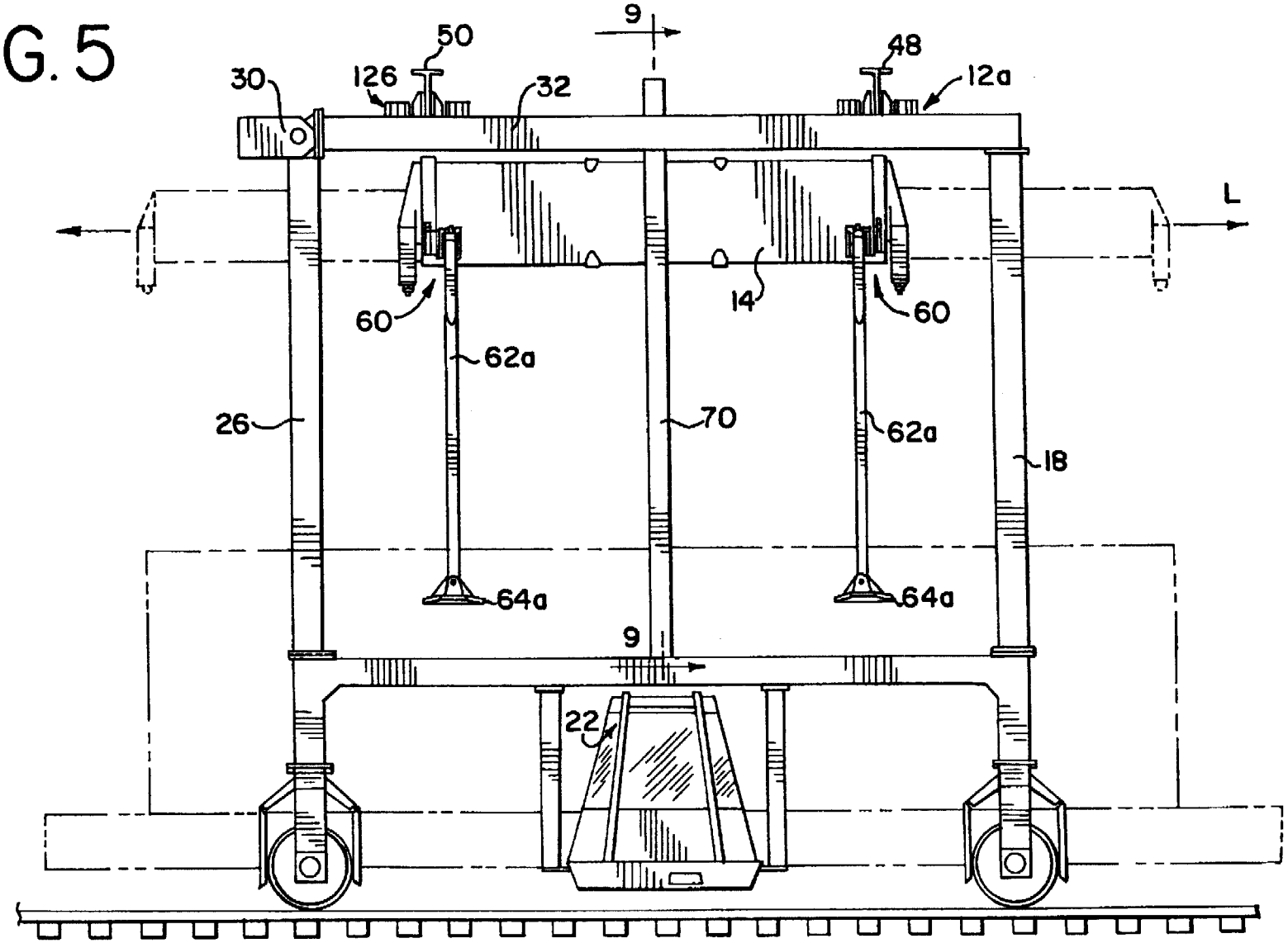
FIG. 5 is a side view of the gantry crane of FIG. 1, some lines shown in phantom illustrating an expandable lift frame and an unengaged resting load within the gantry crane.

As best disclosed in FIGS. 4 and 5, the lift frame 14 is equipped with a pair of spreaders 60. The spreaders 60 have arms 62 that depend from the lift frame 14. Each arm 62 has a twist-lock, or finger 64, that can engage the bottom side of a load, such as a truck trailer. When it is desired or necessary to engage a load at its top, the arms 62 can rotate out of the way (as shown in FIG. 4) and the load can be engaged by hooks 66 located on the lift frame 14. As best disclosed in FIG. 5, the spreaders 60 on the lift frame 14 can extend longitudinally (as shown in phantom) to adjust to various load lengths. The lift frame 14 also houses various control mechanisms for the spreaders 60, as is conventional.

Connected to the top of the lift frame 14, is a four corner cross-reeving/clutch system 79 (FIG. 8) that resists unwanted movement of the ends **14*a* and 14*b* of the lift frame 14, such as rotational sway. The system 79** will be described in more detail below.

As best disclosed in FIGS. 1 and 8, a horizontal stabilizing beam 68 operatively connects the lift frame 14 to the gantry structure 12 to prevent sway of the lift frame 14. The lift frame 14, having a longitudinal axis L (indicated by line L in FIG. 5), is pivotally connected to the stabilizing beam 68 by a gimbal 100. This connection is located between the pair of front legs 18 and 20 and the pair of rear legs 26 and 28. Preferably, the gimbal 100 is located near a midpoint along the longitudinal axis L of the lift frame 14 and thus, between the first cable reeving 56 and second cable reeving 58. As best disclosed in FIG. 8, this connection is also preferably at a lateral center point of the lift frame 14. The gimbal 100 will be described further below.

The stabilizing beam 68 has opposed ends **68*a*, 68*b* (FIG. 9) that are moveable along vertical guides. In a preferred embodiment, the guides are vertical guide tracks 70 and 72 as disclosed in FIG. 9. The guide tracks 70 and 72 are mounted on the side support frames 40 and 42. As best disclosed in FIG. 1, the guide track 70 spans from the top rail 32 to the bottom rail 36 and is positioned between the vertical legs 18 and 26. The opposing guide track 72 (obstructed view in FIG. 1) spans from top rail 34 to bottom rail 38 and is positioned between the vertical legs 20 and 28. The guide tracks 70 and 72 must be sufficiently rigid to withstand forces that are exerted by the stabilizing beam 68 on the guide tracks 70 and 72** during stabilization of sway.

The stabilizing beam 68 is an idler beam and is designed to follow vertical movement of the lift frame 14. The stabilizing beam 68 is only required to resist sway and is not required to bear the load of the lift frame 14. The stabilizing beam 68 is thus lighter than those conventionally used because it does not have to bear the load of the lift frame 14. As best disclosed in FIG. 7, the stabilizing beam 68 is preferably hollow.

The connection of the stabilizing beam 68 to the lift frame 14 by the gimbal 100 also resists lateral sway, or pendulous motion of the entire lift frame 14 from side-to-side. As previously described, this connection is made proximate the center of the lift frame 14. With such a connection, if transverse forces act evenly and in the same direction along a length of the lift frame 14, lateral sway of the lift frame 14 is totally prevented. Rotational sway of the lift frame 14 is also stabilized because any moments created by such transverse forces cancel one another due to the center mounting. Conversely, with a fixed connection at or near only one end of a lift frame as with certain conventional gantry cranes, transverse forces acting evenly and in the same direction along a length of the lift frame 14, create a moment about the fixed end. This moment causes rotational sway of the unsecured end of the lift frame.

The connection of the gimbal 100 proximate the center of the lift frame 14 also provides that any torque or moments which do not cancel out, are created about the center of the lift frame 14 and the gimbal 100. These moments are smaller because of reduced length of the moment arms, i.e., one half of the lift frame. In other words, only a partial length of the lift frame can form the moment arm rather than an entire length of the lift frame 14. These smaller moments are easier to control with supplemental stabilizing apparatus such as the unique cross-reeving/clutch system 79 now to be described.

In the preferred embodiment disclosed herein, additional apparatus is used to further stabilize the lift frame 14 against rotational sway. Specifically and as best disclosed in FIG. 8, a four corner cross-reeving/clutch system 79 is utilized to dampen rotational sway of the ends 14*a* and 14*b* of the lift frame 14. The system 79 utilizes four cables 80, 82, 84 and 86 and four clutch/recoil mechanisms 92, 94, 96 and 98. One end of the cables 80 and 82 are connected at ends 52*a* and 52*b* of trolley 52. One end of the cables 84 and 86 are connected at ends 54*a* and 54*b* of trolley 54.

All of the cables 80, 82, 84 and 86 follow similar paths. For example, cable 80 is connected to the front trolley 52 at end 52*a* and extends down laterally across the end 14*a* of lift frame 14 to a pulley 88 mounted on top of the lift frame 14. The cable 80 then passes under the pulley 88 and towards the end 14*b* of the lift frame 14. The cable 80 proceeds under a pulley 90, and is finally wound about a clutch/recoil mechanism 92. The three other cables 82, 84 and 86 have similar configurations. At one end, cable 82 is connected to the front trolley 52 at end 52*b* thereof and its other end is then wound about clutch/recoil mechanism 94. One end of cable 84 is connected to the rear trolley 54 at end 54*a* and its other end is wound about clutch/recoil mechanism 96. One end of cable 86 is connected to the rear trolley 54 at end 54*b* and its other end is wound about clutch/recoil mechanism 98. In the preferred embodiment and best disclosed in FIG. 8, cables 80 and 82 cross one another before being wound in the clutch/recoil mechanisms 92 and 94 respectively. Cables 84 and 86 cross one another before being wound in the clutch/recoil mechanisms 96 and 98 respectively. The cables 80, 82, 84 and 86 are suspended generally in a vertical plane, parallel with the reevings 56 and 58. However, each cable is suspended at an angle so as to present a resistance vector in at least a partially horizontal direction. Cables 80 and 82 act as a cooperating pair to address opposite lateral vectors at the end 14*a* of lift frame 14 while cables 84 and 86 cooperate to address lateral vectors at the other end 14*b* of lift frame 14.

The four cables 80, 82, 84 and 86 and clutch/recoil mechanisms 92, 94, 96 and 98, all cooperate with each other to dampen rotational sway of the ends 14*a* and 14*b* of the lift frame 14. For example, if a force is exerted to end 14*b* of the lift frame 14 along the vector indicated by arrow F in FIG. 8, slack will develop in cable 84. Clutch/recoil mechanism 96 will recoil cable 84 to take up the slack. Simultaneously, tension will develop in cable 86 that will attempt to pull cable 86 from clutch/recoil mechanism 98. Clutch/recoil mechanism 98 will clutch cable 86 to resist any pay out of cable 86. Thus, the clutch/mechanism 96 operates opposite, or complementary, to the clutch/recoil mechanism 98. That is, when one clutch/recoil mechanism recoils one cable to take up slack, the other clutch/recoil mechanism drags the other cable to resist pay out of the cable. Because the lift frame 14 is pivotally connected at its center by gimbal 100, cables 80 and 82 will cooperate with clutch/recoil mechanisms 92 and 94, respectively, in a similar fashion in response to the opposite or reaction force indicated by arrow RF of FIG. 8. As described with clutch/recoil mechanisms 96 and 98, clutch/recoil mechanism 92 acts opposite, or complementary, to clutch/recoil mechanism 94. Thus, the four corner cross-reeving/clutch system 79 also dampens rotational sway caused by uneven forces acting transverse to the longitudinal axis L of the lift frame 14. If desired, the four corner cross-reeving system 79 could be modified to a two corner cross-reeving system where two cables are connected to a trolley and wound in two corresponding clutch/recoil mechanisms. Even though connected at only one end of the lift frame 14, such a configuration would dampen rotational sway of the entire lift frame due to the central pivotal connection 40 to the stabilizing beam 68.

As previously noted, the gimbal 100 is a pivotal or articulatable connection between the stabilizing beam 68 and lift frame 14. In its preferred form and as best disclosed in FIG. 8, the gimbal 100 connects the stabilizing beam 68 proximate a longitudinal and lateral center of the lift frame 14 or mid-ship of the lift frame 14. Such a connection focuses stabilization near an inertial center of the lift frame 14. The gimbal 100, however, can connect the stabilizing beam 68 at other locations on the lift frame 14 while still maintaining the advantages of the gimbal 100 herein described.

Figure 2:
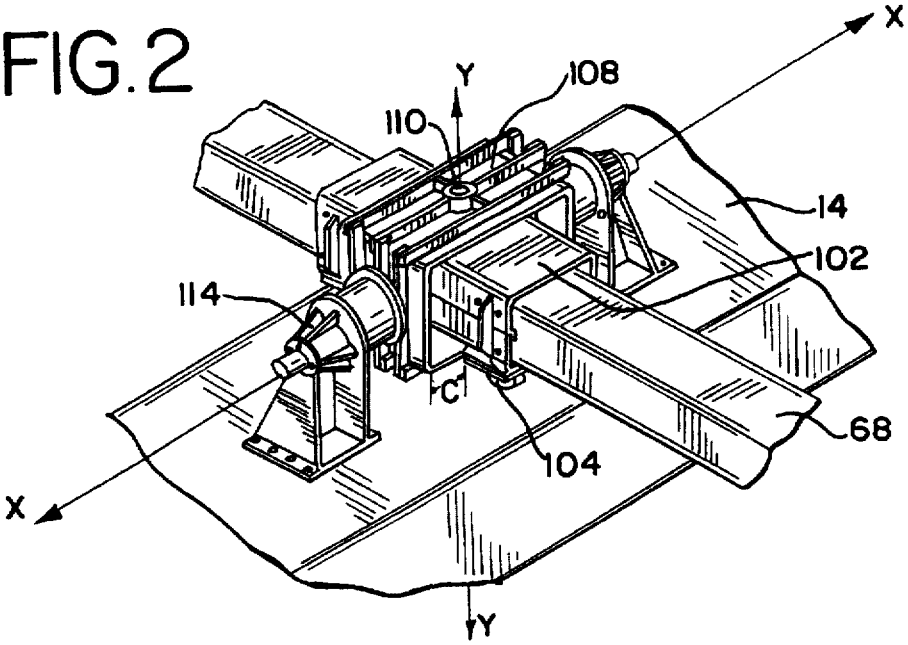
FIG. 2 is an enlarged partial view of the gantry crane of FIG. 1, disclosing in perspective, a gimbal according to the present invention.
Figure 3:
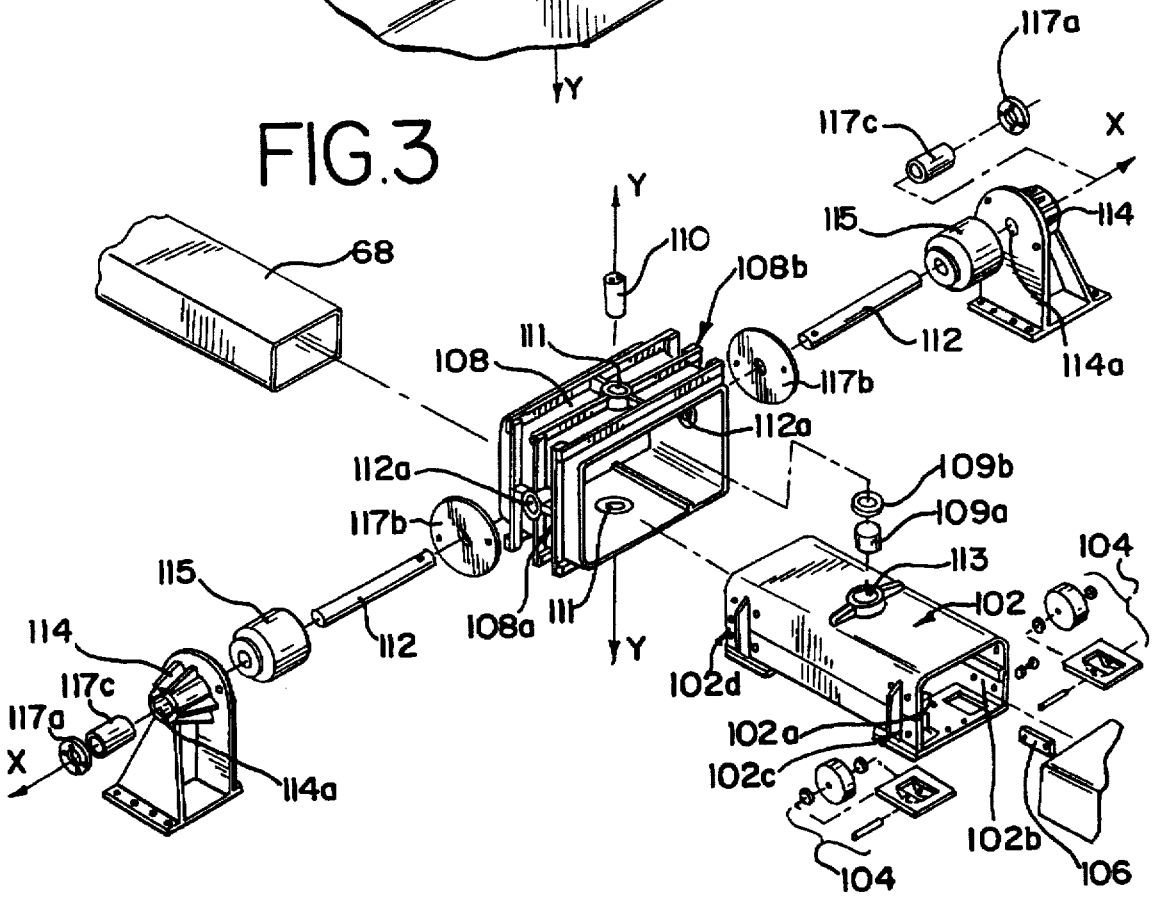
FIG. 3 is an exploded view of the gimbal of FIG. 2.

As best disclosed in FIGS. 2 and 3, the gimbal 100 generally includes a sleeve 102, a cradle 108 and a pair of cradle brackets 114. Sleeve 102 permits the lift frame 14 to move horizontally along the stabilizing beam 68. Preferably, the sleeve 102 slides or rides on the stabilizing beam 68. Wheel assemblies 104 are mounted in the bottom of each end 102*c* and 102*d* of the sleeve 102. The wheels 104 ride on a bottom side of the stabilizing beam 68 to reduce friction when the sleeve 102 moves along the stabilizing beam 68. To further assist in friction reduction, solid, low friction bearings 106 are located on the inside side walls 102*a* and 102*b* of sleeve 102. The low friction material slides against the stabilizing beam 68.

The cradle 108 of gimbal 100 (FIGS. 2 and 3) is positioned around the sleeve 102 and is pivotally connected to the sleeve 102 to allow horizontal rotation of the lift frame 14. In its preferred form, the cradle 108 has a pair of opposing pins 110 that share a common vertical axis Y (bottom pin not shown) in FIGS. 2 and 3. The pins 110 fit into coaxial openings 111 in both the top and bottom of the cradle 108. The pins 110 are received by coaxial openings 113 in the top and bottom of the sleeve 102 (bottom opening of sleeve not shown) in FIGS. 2 and 3. Associated bushings 109*a* and washers 109*b* are provided to reduce friction and to sacrificially wear. The pinned connections 110 permit the cradle 108, and thus the lift frame 14, to rotate in a horizontal plane about the vertical axis Y in FIGS. 2 and 3. Clearance C (FIG. 2) is maintained between the sleeve 102 and the cradle 108 to allow this rotation. With the relative dimensions illustrated in FIGS. 1–3, the cradle 108 has a range of rotation of between 15°–20° about the sleeve 102. Additional rotation can be provided by increasing the clearance C between the cradle 108 and sleeve 102.

As best disclosed in FIGS. 2 and 3, the cradle 108 of gimbal 100 is pivotally connected to the lift frame 14 by cradle brackets 114 to allow rotation of the lift frame 14 about a horizontal axis. A pair of opposing pins 112 that share a common horizontal axis X, extend through openings 114*a* of the cradle brackets 114. The pins 112 are received by openings 112*a* on vertical faces 108*a* and 108*b* of the cradle 108. The cradle brackets 114, in turn, connect to the top of the lift frame thus completing the pivotal, or articulatable connection of gimbal 100 between the lift frame 14 and stabilizing beam 68. The pinned connections 112 allow the lift frame 14 to rotate about the horizontal axis X shared by the pins 112 through the cradle 108 (FIGS. 2 and 3).

Although this rotation can cause the lift frame 14 to slightly rock about the horizontal axis X, the four corner cross-reeving/clutch system 79 will also dampen such rocking.

Also disclosed in FIG. 3, the pins 112 fit through rubber washers 115. The rubber washers 115 absorb shock transmitted from the lift frame 14 to the cradle brackets 114 to protect the cradle 108, the sleeve 102 and the stabilizing beam 68 from impacts during operation. Associated washers 117*a* and 117*b* and bushings 117*c* are also used with brackets 114 for wear and friction reduction.

Figure 7:
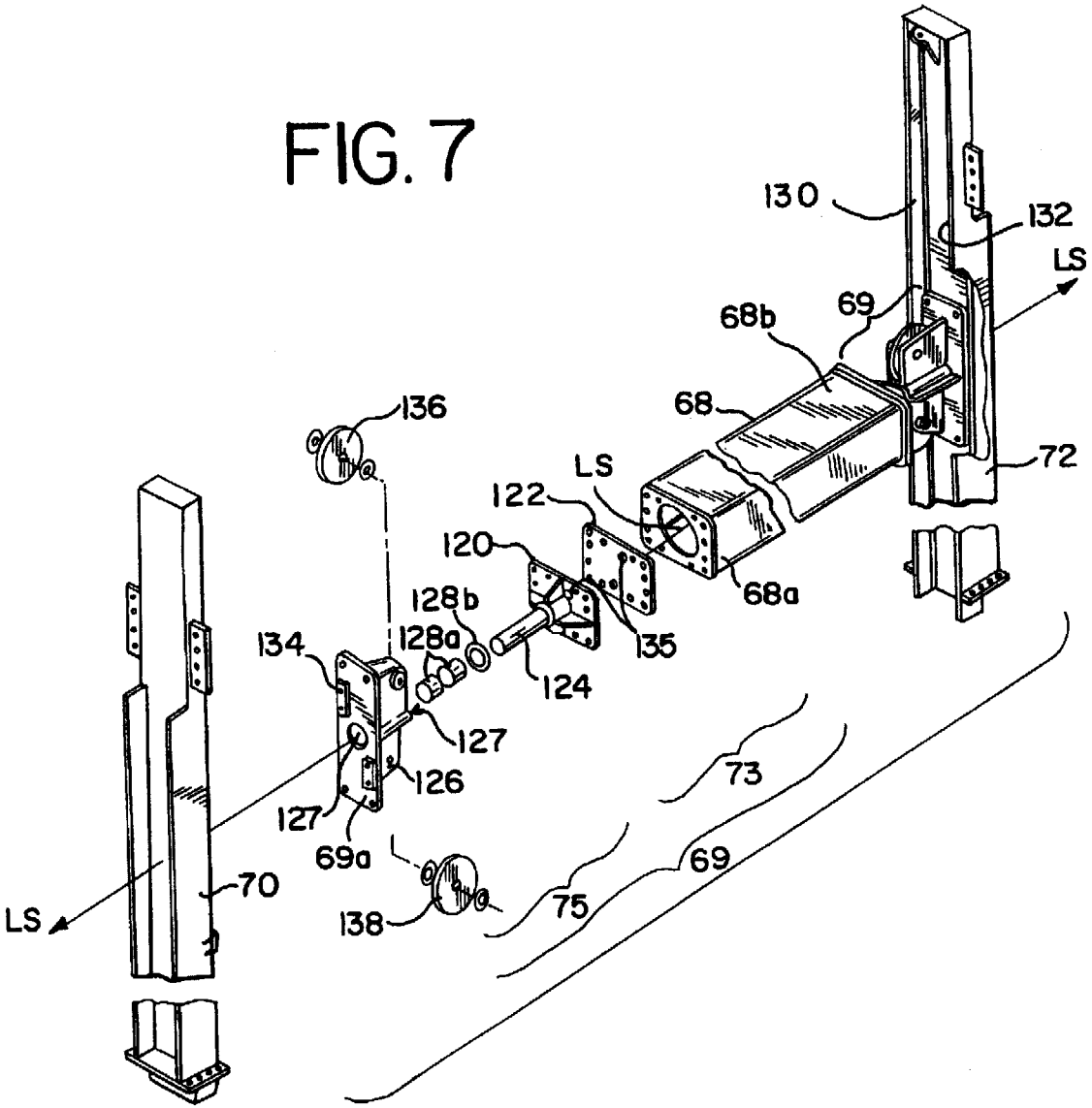
FIG. 7 is an exploded perspective view of one end of a stabilizing beam and vertical guide and an assembled end of the stabilizing beam located within another vertical guide of the gantry crane of FIG. 1.
Figure 6:
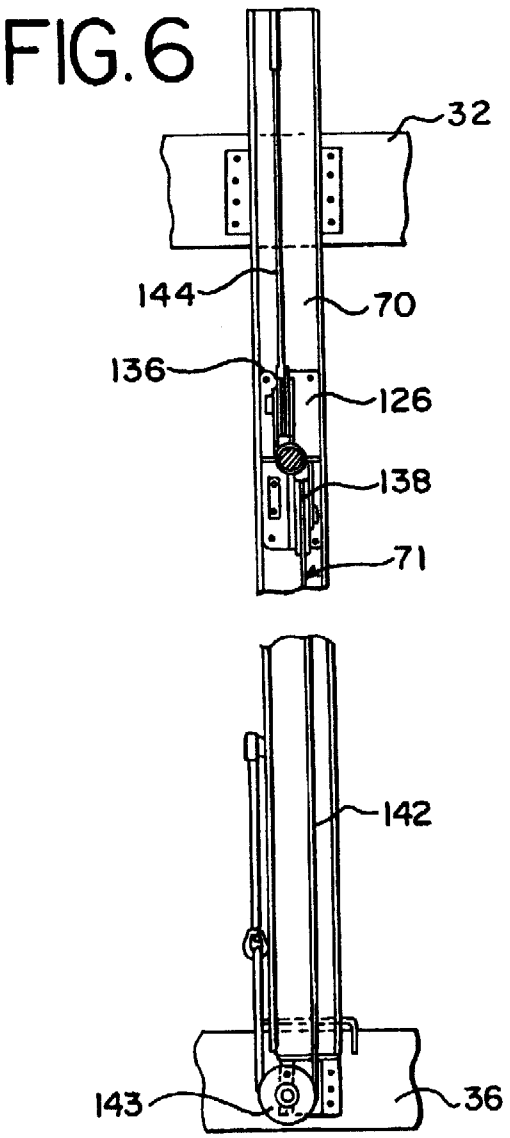
FIG. 6 is a partial view of a cross-sectional view of the gantry crane of FIG. 1 taken along line 6—6 in FIG. 4 disclosing a sheave end bracket within a vertical guide.

FIGS. 6 and 7 disclose the connections between the stabilizing beam 68 and the guide tracks 70 and 72. These connections facilitate rotation of the stabilizing beam 68 about a longitudinal axis, identified by line LS in FIG. 7. Because the stabilizing beam 68 is connected to the lift frame 14, the rotation about longitudinal axis LS facilitates rotation of the lift frame 14 in a vertical plane. As best disclosed in FIG. 7, each end 68*a* and 68*b* of the stabilizing beam 68 has a rotatable joint 69 that cooperates with an idler reeving 71 (FIGS. 6 and 9). An end portion 69*a* of each rotatable joint 69 rides in guide track 70 or 72.

Each rotatable joint 69 has a male section 73 that is rotatable within a female section 75. In its preferred embodiment, the male section 73 is connected to the stabilizing beam 68 and the female section 75 is positioned within the guide tracks 70 and 72. It will be understood, however, by those skilled in the art that the male section 73 and the female section 75 could be reversed while still obtaining the benefits of the invention.

The male section 73 includes a pivot bracket 120 that is bolted to the end 68*a* of the stabilizing beam 68. One or more spacer plates 122 can be added to adjust a length of the stabilizing beam 68 for proper connection. The pivot bracket 120 has a pin 124 that cooperates with an opening 127 in the female section 73. An identical male section is connected to the end 68*b* of the stabilizing beam 68 in FIG. 7.

The female section 73 includes a sheave end bracket 126 having the opening 127 for receiving the pin 124 of the male section 73. Each sheave end bracket 126 has two sheaves 136, 138 and 140, 142 respectively, that receive idler reeving 71 to be described below. The sheave end brackets 126 fit within the opposing flanges 130 and 132 of guide tracks 70 and 72. Slide bearings 134 are mounted on the back of the sheave end brackets 126 to reduce friction during vertical movement of the sheave end brackets 126 along the guide tracks 70 and 72. Associated bushings 128*a* and washers 128*b* are also employed to reduce friction and wear of major components.

Because each pin 124 is rotatable within each sheave end bracket 126, the stabilizing beam 68 can rotate about its longitudinal axis LS (FIG. 7), thus facilitating the rotation of the lift frame 14 in a vertical plane, i.e., tipping.

FIGS. 6 and 9 disclose the idler reeving 71 utilized with the stabilizing beam 68 to assure that the stabilizing beam 68 remains horizontal at all times. FIG. 9 discloses some lines in phantom so that the idler reeving 71 is clearly shown. The idler reeving 71 includes cables 144 and 146. The cable 144 is fixed at the top of the guide track 70 and passes down under the sheave 136. Cable 144 then proceeds through the length of the hollow stabilizing beam 68 toward end 68*b*. Cable ports 135 (FIG. 7) in the pivot end plate 120 and spacer plate 122 allow the cables 144 and 146 to pass into the hollow stabilizing beam 68. The cable 144 then exits the end 68*b* and passes over sheave 142 mounted on the sheave end bracket 126 within the guide track 72. The cable 144 then proceeds down to the bottom of the guide track 72 where it passes under a sheave (not shown) located at the bottom of guide track 72. Cable 144 is then fixed beside guide track 72. Cable 146 follows a similar path and is first fixed at the top of guide track 72. Cable 146 passes down under the sheave 140 on sheave end bracket 126 within guide track 72, through the length of the stabilizing beam 68 towards end 68*a*, and over sheave 138 on sheave end bracket 126 within guide track 70. The cable 146 then passes down to the bottom of guide track 70 and under a sheave 143 (FIG. 6). Cable 146 is then fixed beside guide track 70 (FIG. 6).

The cables 144 and 146 are the same length and therefore, when the end 68*a* of stabilizing beam 68 and the sheave 136 are lowered requiring more length of cable 144, end 68*b* of stabilizing beam 68 and sheave 142 are also lowered an equal distance to give end 68*a* and sheave 136 the required amount of cable 144. Sheaves 138 and 140 operate in the same manner with cable 146. Thus, the stabilizing beam 68 will remain horizontal at all times.

Maneuverability of the Lift Frame During Operation

In operation, the gantry crane 10 can span over a truck trailer positioned adjacent a railcar, for example, to lift the trailer onto the railcar as shown in FIG. 4. Longitudinal sway and lateral sway of the entire lift frame 14 are stabilized by the stabilizing beam 68 connected at mid-ship of the lift frame 14 by the gimbal 100. Rotational sway of the ends 14*a* and 14*b* of the lift frame 14 is dampened by the four corner cross-reeving/clutch system 79.

FIGS. 10–12 disclose, schematically, the maneuverability maintained by the lift frame 14 while still being stabilized against sway.

The gimbal 100 allows two separate rotations of the lift frame 14, i.e., rotation in a horizontal plane about a vertical axis and rotation about a horizontal axis.

As previously described, the cradle 108 of the gimbal 100 is pivotally connected to the sleeve 102 by pins 110. The pins 110 share a common longitudinal axis Y (FIGS. 2 and 3). Therefore, cradle 108, and in turn, the lift frame 14, can rotate in a horizontal plane about the Y axis. FIG. 10 discloses a schematic top view of the gantry structure 12 and lift frame 14. The lift frame 14 is pivotally connected to the stabilizing beam 68 by the gimbal 100. The gimbal 100 allows the lift frame 14 to rotate, as shown by the arrows, in a horizontal plane about vertical axis Y (rotation shown in phantom). With this rotation, the trolleys 52 and 54 of the gantry crane 10 can operate independently of one another, i.e. trolley 52 can move laterally to the right or left while trolley 54 can move laterally to the left or right respectively. Therefore, the lift frame 14 and load can be angularly aligned between the side support frames 40 and 42. Rotating the load horizontally is sometimes necessary to accurately maneuver the load such as when any of a trailer, railcar or the gantry crane 10 are not in parallel alignment with each other. To accurately place a truck trailer onto an angled railcar, for example, an operator must horizontally rotate the lift frame 14.

The gimbal 100 also allows rotation of the lift frame 14 about a horizontal axis. As previously described, the lift frame 14 is connected to the cradle 108 by pins 112 having a common horizontal axis X (FIGS. 2 and 3). The lift frame 14 can thus rotate about the horizontal axis X. FIG. 11*a* is a schematic front view of the gantry structure 12 disclosing this rotation. The arrows show the rotation of the lift frame 14 about the horizontal axis X. This rotation provides the ability of the lift frame 14 to engage a load such as load C of FIG. 11*b*, resting at an angle A. For example, the lift frame 14 can rotate, about horizontal axis X, to the same angle A as the load C, to engage the load C.

The rotatable joints 69 (FIG. 7) that connect the stabilizing beam to the guide tracks 70 and 72 allow the lift frame 14 to rotate in a vertical plane. FIG. 12 is a schematic side view of the gantry structure 12 disclosing rotation of the lift frame 14 in a vertical plane as indicated by the arrows. Therefore, with the rotatable stabilizing beam 68 of gantry crane 10, the trolleys 52 and 54 may raise and lower the ends 14*a* and 14*b* of the lift frame 14 independently of each other. Raising or lowering one end of the lift frame 14 is sometimes required to engage or to accurately maneuver a load.

Therefore, the gantry crane 10 of the present invention has a stabilizing apparatus that prevents sway of the lift frame 14 while maintaining three-dimensional maneuverability of the lift frame 14. The gimbal 100 facilitates the ability of the lift frame 14 to rotate in a horizontal plane about the vertical axis Y. The gimbal 100 also facilitates rotation of the lift frame 14 about the horizontal axis X parallel with the longitudinal axis L of the lift frame 14. The rotatable joints 69 that connect the stabilizing beam 68 to the guide tracks 70 and 72 allow the lift frame 14 to rotate in a vertical plane.

While the invention has been described with reference to some preferred embodiments of the invention, it will be understood by those skilled in the art that various modifications may be made and equivalents may be substituted for elements thereof without departing from the broader aspects of the invention.

For example, the means for stabilizing the lift frame is disclosed as a single stabilizing beam 68. However, it is believed that any significantly rigid structure such as even a taut cable spanning within the gantry structure 12 would provide significant advantages configured according to the invention. The means for stabilizing could also be multiple stabilizing beams that operatively connect the lift frame 14 to the gantry structure 12.

The vertical guides are disclosed as guide tracks 70 and 72 in the preferred embodiment of the invention. However, guides could also be configured as taut cables. Rigid poles could also be used as vertical guides that cooperate with external slidable sleeves connected to ends of the stabilizing beam 68.

Although the rotatable joints 69 are located at the ends 68*a* and 68*b* of the stabilizing beam 68, other configurations could be used for rotation of the lift frame 14 in a vertical plane. For example, a stabilizing beam could be provided with a portion thereof, which is connected to the lift frame 14, rotatable about the longitudinal axis of the stabilizing beam while the ends thereof are not rotatable.

In the preferred embodiment of the invention, the means for connecting the stabilizing beam 68 to the lift frame 14 is a gimbal 100. The pivotal connections are formed by pins 110 and 112. The means for connecting, however, could utilize other structure to form the pivotal connections. For example, the means for connecting could be configured as a ball-and-socket articulating joint between the stabilizing beam 68 and lift frame 14. The means for connecting could also be formed by a single ring connected at its outer diameter to the lift frame Such a ring should fit about the stabilizing beam 68 with clearance between an inner diameter of the ring and an outer surface of the stabilizing beam 68.

The sleeve 102 and cradle 108 of the gimbal 100 are both disclosed as rectangular in the preferred embodiment of the invention. However, the sleeve 102 could have a circular configuration, such as if the stabilizing beam 68 had a circular cross-section. The cradle 108 could also be circular and further be configured to only encircle a portion of the sleeve 102.

Finally, the preferred embodiment of the gimbal 100 permits the lift frame 14 to rotate about a horizontal axis X that passes above and along the longitudinal axis L of the lift frame 14. The horizontal axis X, however, does not have to be located above the longitudinal axis L of the lift frame 14. For example, the means for connecting the stabilizing beam 68 to the lift frame 14 could be modified where the lift frame 14 would rotate about its own longitudinal axis L.

The present examples and embodiments, therefore, are illustrative and should not be limited to such details.

We claim:

1. A gantry crane comprising:

a gantry structure having a pair of front support legs and a pair of rear support legs and rails connecting the front support legs to the rear support legs;

a lift frame suspended from the gantry structure, the lift frame having a longitudinal axis;

a stabilizing beam connecting the lift frame to the gantry structure, the stabilizing beam being positioned between the pair of front support legs and the pair of rear support legs, and being transverse to the rails; and, a means for connecting the stabilizing beam to the lift frame, the means permitting rotation of the lift frame about a horizontal axis which axis is generally parallel to the longitudinal axis, wherein the means for connecting the stabilizing beam to the lift frame is a gimbal having a sleeve moveable on the stabilizing beam, and a cradle pivotally connected to the sleeve and pivotally connected to the lift frame.

2. A gantry crane comprising:

a gantry structure having a pair of front support legs and a pair of rear support legs and rails connecting the front support legs to the rear support legs;

a lift frame suspended from the gantry structure, the lift frame having a longitudinal axis;

a stabilizing beam connecting the lift frame to the gantry structure, the stabilizing beam being positioned between the pair of front support legs and the pair of rear support legs, and being transverse to the rails;

a means for connecting the stabilizing beam to the lift frame, the means permitting rotation of the lift frame about a horizontal axis which axis is generally parallel to the longitudinal axis, and;

vertical guides connected on opposing sides of the gantry structure wherein the stabilizing beam is rotatable about its longitudinal axis within the vertical guides.

3. A gantry crane comprising:

a pair of side support frames having vertical guide tracks proximate the center of the side support frames, the side support frames being spaced by first and second cross-beams;

a first trolley moveable on the first cross-beam;

a second trolley moveable on the second cross-beam;

a lift frame having opposed ends and means for engaging a load to be lifted;

suspension means for raising and lowering the lift frame from the first and second trolleys;

a four corner cross-reeving/clutch system connected between the trolleys and lift frame;

a stabilizing beam having a longitudinal axis and opposed ends moveable along the vertical guide tracks, the opposed ends being rotatable within the vertical guide tracks about the longitudinal axis of the stabilizing beam; and a gimbal connecting the stabilizing beam to the lift frame, the gimbal having a sleeve moveable on the stabilizing beam and a cradle pivotally connected to the sleeve, the cradle being pivotally connected to the lift frame at proximate a center of the lift frame.

* * * * *

UNITED STATES PATENT AND TRADEMARK OFFICE

CERTIFICATE OF CORRECTION

PATENT NO. : 5,715,958

DATED : February 10, 1998

INVENTOR(S) : Thomas Feider, Norbert Lenius

It is certified that error appears in the above-identified patent and that said Letters Patent is hereby corrected as shown below:

In Column 11, Line 61, insert -- 14. -- after "frame" and before "Such".

Signed and Sealed this

Twenty-third Day of June, 1998

*Attest:*

*Attesting Officer*

BRUCE LEHMAN

*Commissioner of Patents and Trademarks*